US007275880B2

(12) United States Patent
Obuchi et al.

(10) Patent No.: US 7,275,880 B2
(45) Date of Patent: Oct. 2, 2007

(54) THERMAL ACTIVATION APPARATUS

(75) Inventors: Tatsuya Obuchi, Chiba (JP); Minoru Hoshino, Chiba (JP); Yoshinori Sato, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 135 days.

(21) Appl. No.: 10/844,288

(22) Filed: May 12, 2004

(65) Prior Publication Data

US 2004/0258447 A1 Dec. 23, 2004

(30) Foreign Application Priority Data

Jun. 10, 2003 (JP) ..... 2003-165211

(51) Int. Cl.
*B41J 2/315* (2006.01)

(52) U.S. Cl. ..... 400/120.01; 400/708; 347/171; 347/218

(58) Field of Classification Search ..... 400/120.01, 400/621, 611, 708; 347/217, 220, 171, 177, 347/218

See application file for complete search history.

(56) References Cited

U.S. PATENT DOCUMENTS 4,397,709 A * 8/1983 Schwenzer ..... 156/351
4,468,274 A * 8/1984 Adachi ..... 156/320
6,031,553 A 2/2000 Nagamoto et al.
6,867,792 B2 * 3/2005 Hoshino et al. ..... 347/218
6,947,066 B2 * 9/2005 Sato et al. ..... 247/217
2004/0004656 A1 * 1/2004 Sambongi et al. ..... 347/171
2004/0017434 A1 * 1/2004 Okayasu et al. ..... 347/56

FOREIGN PATENT DOCUMENTS

EP 1354718 10/2003

* cited by examiner

*Primary Examiner*—Andrew H. Hirshfeld
*Assistant Examiner*—Kevin D. Williams
(74) *Attorney, Agent, or Firm*—Adams & Wilks

(57) ABSTRACT

A thermal activation apparatus comprises a housing having an insertion slot for insertion therethrough of a heat-sensitive adhesive sheet. A sensor detects the heat-sensitive adhesive sheet inserted through the insertion slot and outputs a corresponding detection signal for determining a start time of the thermal activation apparatus. A transfer unit transfers the heat-sensitive adhesive sheet and a thermal activation unit thermally activates a heat-sensitive adhesive layer of the heat-sensitive adhesive sheet. An ejection unit ejects the heat-sensitive adhesive sheet after thermal activation. A control unit disposed within the housing controls operation of the thermal activation apparatus and includes a printer communication unit for communicating the thermal activation apparatus with a printer for printing on a printable surface of the heat-sensitive adhesive sheet before or after thermal activation of the heat-sensitive adhesive layer of the heat-sensitive adhesive sheet.

24 Claims, 8 Drawing Sheets

THERMAL ACTIVATION APPARATUS

BACKGROUND OF THE INVENTION

1. Field of the invention

In one aspect the present invention relates to a heat-sensitive adhesive sheet thermal activation apparatus for thermally activating a heat-sensitive adhesive agent layer formed on one surface of a sheet-like substrate material. In another aspect, the present invention relates to a heat-sensitive adhesive sheet printer for printing on a printable layer formed on the other surface of the sheet substrate material.

2. Description of the Related Art

One of the sheets that are to be attached onto commodities in recent years is a heat-sensitive adhesive sheet. This heat-sensitive adhesive sheet is a print medium in which a heat-sensitive adhesive agent layer that exhibits non-adhesivity normally but shows adhesivity when heated is formed on one surface of a sheet substrate material and a printable layer is formed on the other surface, and it is widely used, for example, as POS sheets for food, distribution sheets, delivery sheets, medical sheets, baggage tugs, display sheets for bottles and cans, and so forth.

As a heat-sensitive adhesive sheet printer for printing on the heat-sensitive adhesive sheet such as described above, one that has been suggested is provided with a thermal activation apparatus such that a head having, as its heat source, a plurality of resistors (heat-generating elements) provided on a ceramic substrate, like a thermal head utilized as a print head of a thermal printer, is brought into contact with a heat-sensitive adhesive agent layer of a heat-sensitive adhesive label to heat it (see, for example, Patent Document 1).

Here, a general configuration of a conventional heat-sensitive adhesive sheet printer is described with reference to FIG. 8. The heat-sensitive adhesive sheet printer of FIG. 8 comprises a roll accommodating unit B for holding a tape-like heat-sensitive adhesive label A that is wound in a roll-like state, a print unit C for printing on the heat-sensitive adhesive label A, a cutter unit D for cutting the heat-sensitive adhesive sheet A into labels with a predetermined length, and a thermal activation unit E, serving as a thermal activation apparatus, for thermally activating a heat-sensitive adhesive agent layer of the heat-sensitive adhesive label A.

The print unit C comprises: a printing thermal head G that has a plurality of heat-generating elements F including a plurality of relatively small resistors arranged in the width direction so that dot printing is possible; a printing platen roller H that is to be pressure-contacted with the printing thermal head G (heat-generating element F); and so forth. In FIG. 8, the printing platen roller H is rotated clockwise, and the heat-sensitive adhesive label A is transferred to the right.

The cutter unit D is for cutting the heat-sensitive adhesive label A that has been printed by the print unit C at an appropriate length, and comprises a movable blade I that is operated by a driving source (not shown in the figure) such as an electric motor or the like, a stationary blade J opposing the movable blade I, and so forth.

The thermal activation unit E comprises: a thermal activation thermal head L serving as a heating means and having a heat-generating element K; a thermal activation platen roller M for transferring the heat-sensitive adhesive label A and serving as a transfer means; a pull-in roller N for pulling the heat-sensitive adhesive label A supplied from the print unit C side into a gap between the thermal activation thermal head L (heat-generating element K) and the thermal activation platen roller M;and so forth. In FIG. 8, the thermal activation platen roller M is rotated in a direction opposite to the printing platen roller H (anticlockwise) so that the heat-sensitive adhesive label A is transferred to a predetermined direction (to the right).

[Patent Document 1]

JP-A-11-79152.

The conventional heat-sensitive adhesive sheet printer has have the following problems since the print unit for printing on the printable layer of the heat-sensitive adhesive sheet and the thermal activation unit for thermally activating the heat-sensitive adhesive agent layer are formed integrally.

(1) It is impossible to selectively carry out only one of the print onto the printable layer or the thermal activation of the heat-sensitive adhesive agent layer. Accordingly, it is impossible to carry out such an operation that only the printing onto the printable layer is performed in advance and the heat-sensitive adhesive agent layer is thermally activated to affix it on to a subject material as needed. That is, so-called "affixing-at-once" is impossible.

(2) The print onto the above-mentioned printable layer is possible even with a general-purpose printer, which is not exclusively designed for heat-sensitive adhesive sheets. However, as described above, the conventional heat-sensitive adhesive sheet printer has a configuration in-which the print and the thermal activation are performed in a series. Accordingly, it is impossible to carry out only the thermal activation of the heat-sensitive adhesive sheet printed with the use of a general-purpose printer. After all, when using the heat-sensitive adhesive sheet, a dedicated heat-sensitive adhesive sheet printer must be prepared separately.

SUMMARY OF THE INVENTION

One of the objects of the invention is to provide a heat-sensitive adhesive sheet thermal activation apparatus that is capable of thermally activating the heat-sensitive adhesive agent layer of the heat-sensitive adhesive sheet as needed. Another object of the invention is to provide a heat-sensitive adhesive sheet thermal activation apparatus that is attachable/detachable to a printer as needed. Another object of the invention is to provide a heat-sensitive adhesive sheet printer to which a heat-sensitive adhesive sheet thermal activation apparatus is attachable/detachable as needed.

In order to accomplish the above-described objects, a heat-sensitive adhesive sheet thermal activation apparatus according to the invention comprises at least: an insertion slot for inserting a heat-sensitive adhesive sheet in which a printable layer is formed on one surface of a sheet-like substrate material and a heat-sensitive adhesive agent layer is formed on the other surface thereof; transfer means for transferring the heat-sensitive adhesive sheet that has been inserted to the insertion slot; thermal activation means for thermally activating the heat-sensitive adhesive agent layer of the heat-sensitive adhesive sheet by heating; and ejection means for ejecting the heat-sensitive adhesive sheet in which the heat-sensitive adhesive agent layer has been thermally activated; whereby it is made possible to thermally activate, as needed, a heat-sensitive adhesive agent layer of a heat-sensitive adhesive sheet printed by a separate printer. In addition, it is made possible to thermally activate the heat-sensitive adhesive agent layer of the heat-sensitive adhesive sheet in advance, and to print or hand-write on the printable layer after attaching the heat-sensitive adhesive sheet onto a subject material.

In addition, an insertion slot is provided for inserting an already-printed heat-sensitive adhesive sheet ejected from a printer capable of printing on the printable layer of a heat-sensitive adhesive sheet in which a printable layer is formed on one surface of a sheet-like substrate material and a heat-sensitive adhesive agent layer is formed on the other surface, and it is made possible to accept the heat-sensitive adhesive sheet printed by a separate printer and thermally activate the heat-sensitive adhesive agent layer of the heat-sensitive adhesive sheet.

In addition, printer attaching/detaching means is provided for permitting a printer to be attachable/detachable, the printer being capable of printing on the printable layer of a heat-sensitive adhesive sheet in which a printable layer is formed on one surface of a sheet-like substrate material and a heat-sensitive adhesive agent layer is formed on the other surface, and it is made possible to couple the heat-sensitive adhesive sheet thermally activation apparatus with a printer and to thermally activate the heat-sensitive adhesive agent layer of the heat-sensitive adhesive sheet printed by the printer.

In addition, cutting means is provided for cutting the heat-sensitive adhesive sheet at a desired length, and it is made possible to cut the heat-sensitive adhesive sheet at a desired length before the heat-sensitive adhesive agent layer is thermally activated or after thermally activated.

In addition, printer communication means is provided for performing communication with a printer capable of printing on the printable layer of the heat-sensitive adhesive sheet, and it is made possible to control the printer or conversely receive control from the printer, or to perform control according to the operation status of the printer.

In order to accomplish the foregoing object, a heat-sensitive adhesive sheet printer of the invention comprises: printing means for printing on the printable layer of a heat-sensitive adhesive sheet in which a printable layer is formed on one surface of a sheet-like substrate material and a heat-sensitive adhesive agent layer is formed on the other surface; transfer means for transferring the heat-sensitive adhesive sheet to the printing means; paper-ejecting means for ejecting the heat-sensitive adhesive sheet that has already been printed; and thermal activation apparatus-attaching/detaching means for attaching/detaching a heat-sensitive adhesive sheet thermal activation apparatus for thermally activating the heat-sensitive-adhesive agent layer of the heat-sensitive adhesive sheet; whereby it is usable as both a conventional heat-sensitive adhesive sheet printer in which a thermal activation mechanism is integrally provided and a normal printer.

In addition, thermal activation apparatus communication means is provided for performing communication with a heat-sensitive adhesive sheet thermal activation apparatus, and it is made possible to control the thermal activation apparatus, or conversely receive control from the thermal activation apparatus, or to perform control according to the operation status of the thermal activation apparatus.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERRED EMBODIMENTS

[Embodiment 1]

Figure 1:
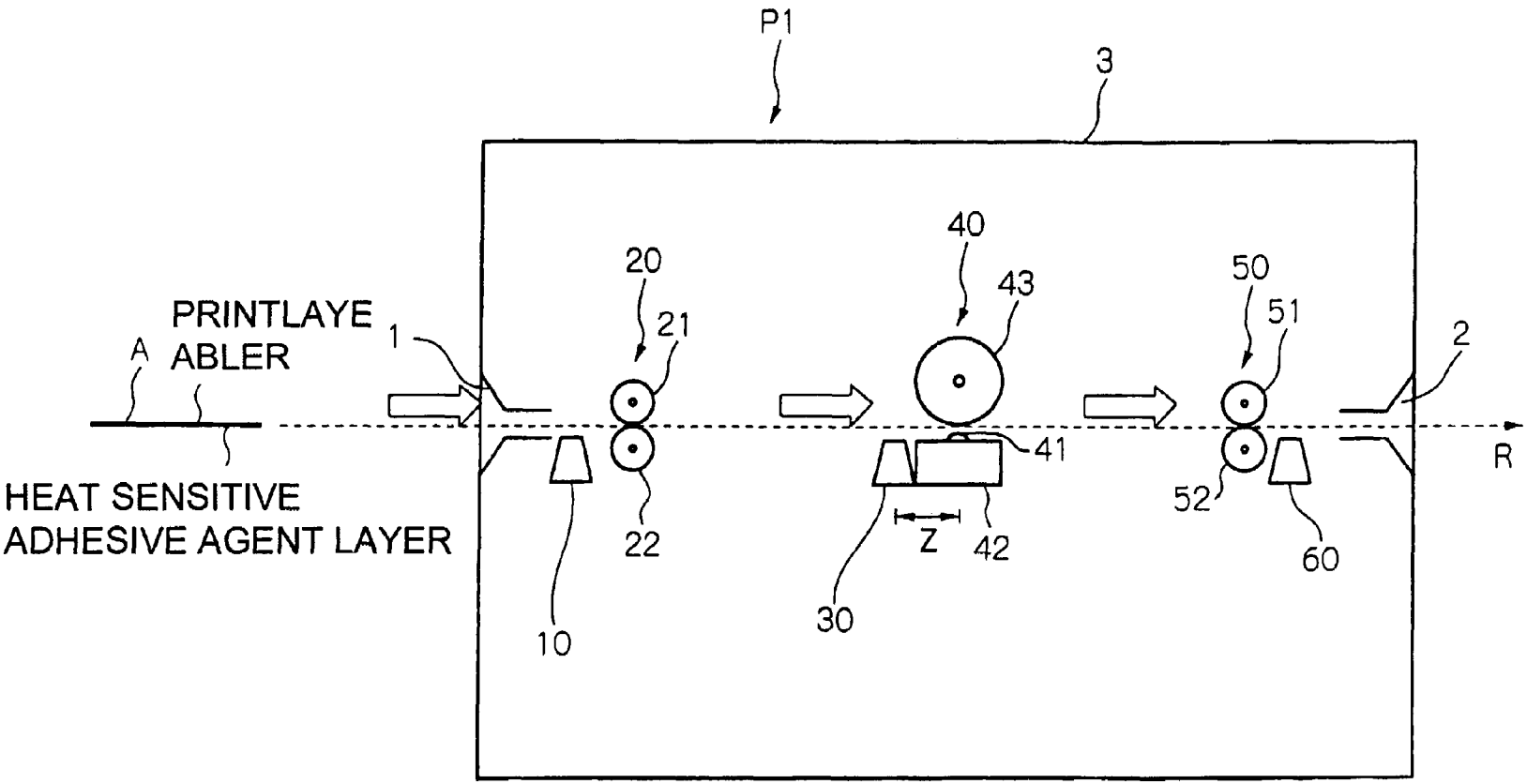
FIG. 1 is a configuration view showing the outline of a heat-sensitive adhesive sheet thermal activation apparatus of Embodiment 1.
Figure 2:
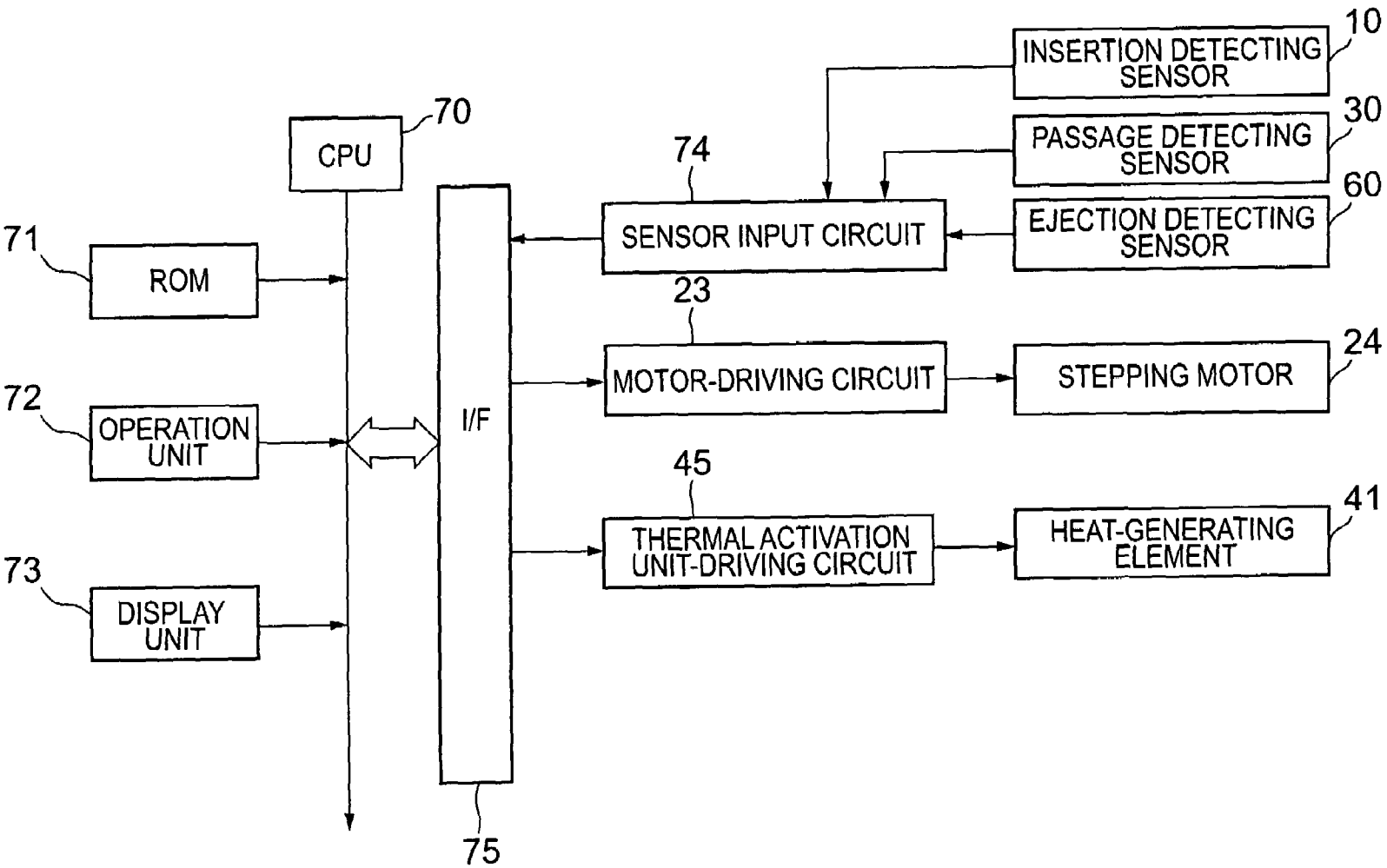
FIG. 2 is a block diagram of a control system and a drive system of the heat-sensitive adhesive sheet thermal activation apparatus shown in FIG. 1.

Hereinbelow, one embodiment of a heat-sensitive adhesive sheet thermal activation apparatus of the invention is explained in detail with reference to drawings. FIG. 1 is a schematic view showing the configuration of a heat-sensitive adhesive sheet thermal activation apparatus of the invention (hereinafter referred to as "thermal activation apparatus P1"). FIG. 2 is a block diagram showing the outline of a control system and a drive system of the thermal activation apparatus P1 of the invention. As shown in FIG. 1, the thermal activation apparatus P1 has a housing 3 in which an insertion slot 1, into which a heat-sensitive adhesive sheet A is inserted, and an ejection slot 2, from which the heat-sensitive adhesive sheet A is ejected, are formed. In the interior of the housing 3, an insertion-detecting sensor 10, a pair of pull-in rollers 20, a passage-detecting sensor 30, a thermal activation unit 40, a pair of ejection rollers 50, and an ejection-detecting sensor 60 are provided along a transfer path R of the heat-sensitive adhesive sheet A. Although omitted in FIG. 1, the control system and the drive system shown in FIG. 2 are also provided in the interior of the housing 3. The control system shown in FIG. 2 comprises: a CPU 70 serving as a control means for centrally managing the insertion-detecting sensor 10, the pull-in rollers 20, the passage-detecting sensor 30, the thermal activation unit 40, the ejection rollers 50, the ejection-detecting sensor 60, and so forth; a ROM 71 that stores a control program executed by the CPU 70; an operation unit 72 for inputting various necessary data and calling the input data; a display unit 73 for displaying data that are input/output and other data; and so forth. The drive system shown in FIG. 2 will be described later.

Here, there are no particular limitations to the heat-sensitive adhesive sheet A the heat-sensitive adhesive agent layer of which is thermally activated by the thermal activation apparatus P1. For example, a heat-sensitive adhesive label such as described in the previously-mentioned Patent Document 1 is also included, in which a heat insulating layer and a heat-sensitive coloring layer (printable layer) are formed on an obverse surface of a sheet substrate material, and a heat-sensitive adhesive agent layer formed by coating and drying a heat-sensitive adhesive agent on the reverse surface. It should be noted that a general heat-sensitive adhesive agent has a thermoplastic resin, a solid plastic resin, or the like as its main component, and there are no particular limitations to the composition of the heat-sensitive adhesive agent either. In addition, the heat-sensitive adhesive sheet A includes a heat-sensitive adhesive label or the like in which a protective layer or a colored print layer (a layer that has been printed in advance) is formed oh the surface of the heat-sensitive coloring layer.

The insertion slot 1 shown in FIG. 1 is formed in a side face of the housing 3, which has substantially a rectangular shape, and the ejection slot 2 is formed in a side face of the housing 3 that opposes the side face in which the insertion slot 1 is formed. Nevertheless, there are no particular restrictions on the positions of the insertion slot 1 and the ejection slot 2 to be formed, and they may be formed at other positions than the foregoing.

The insertion-detecting sensor 10 shown in FIG. 1 is an optical sensor and is installed at a position that is nearer the pull-in rollers 20 at a predetermined distance than the insertion slot 1. The insertion-detecting sensor 10 optically detects the fore-end of the heat-sensitive adhesive sheet A that is inserted from the insertion slot 1 and outputs a sensor signal (insertion-detecting signal) to a sensor input circuit 74 shown in FIG. 2. The sensor input circuit 74 outputs the input insertion-detecting signal to the CPU 70 via an interface (I/F 75). Nevertheless, the insertion-detecting sensor 10 may be a mechanical sensor or other sensors.

The pull-in rollers 20 shown in FIG. 1 comprise an upper pull-in roller 21 (active roller) disposed upward of a transfer path R of the heat-sensitive adhesive sheet A and a lower pull-in roller 22 (passive roller) disposed downward thereof. A stepping motor 24, which is controlled by the CPU 70 through a motor-driving circuit 23 shown in FIG. 2, is coupled to the upper pull-in roller 21 via a transmission mechanism, which is not shown in the drawings. On the other hand, the lower pull-in roller 22 is rotatably attached on a rotational shaft. Then, when the stepping motor 24 is driven in response to a drive signal output from the motor-driving circuit 23 that has received an instruction from the CPU shown in FIG. 2, the upper pull-in roller 21 shown in FIG. 1 rotates anticlockwise so as to pull the heat-sensitive adhesive sheet A inserted from the insertion slot 1 between the upper and lower pull-in rollers 21 and 22 and transfer it toward a thermal activation unit 40. At this time, the lower pull-in roller 22 is driven-rotated according to the shift of the heat-sensitive adhesive sheet A while bringing the heat-sensitive adhesive sheet A into pressure-contact with the upper pull-in roller 21. Nevertheless, the lower pull-in roller 22 may be made an active roller by coupling it to the stepping motor 24, and the upper pull-in roller 21 may be a passive roller.

The passage-detecting sensor 30 shown in FIG. 1 is an optical sensor and is installed in front of the thermal activation unit 40 with respect to the transfer direction of the heat-sensitive adhesive sheet A. The passage-detecting sensor 30 optically detects the heat-sensitive adhesive sheet A that is fed into the thermal activation unit 40 by the pull-in rollers 20 and outputs a sensor signal (passage-detecting signal) to the sensor input circuit 74 shown in FIG. 2. The sensor input circuit 74 outputs the input passage-detecting signal to the CPU 70. Nevertheless, the passage-detecting sensor 30 may be a mechanical sensor or other sensors.

The thermal activation unit 40 shown in FIG. 1 comprises: a thermal activation thermal head 42 having a plurality of heat-generating elements 41; a thermal activation platen roller 43 for transferring the heat-sensitive adhesive sheet A; the stepping motor 24 shown in FIG. 2, which is also a driving source of the thermal activation platen roller 43; a thermal activation unit-driving- circuit 45 for driving the thermal activation thermal head 42 (heat-generating elements 41) and the heat-generating elements 41; a transmission mechanism, not shown in the drawings, for transmitting a rotational driving force of the stepping motor 24 to the thermal activation platen roller 43; and so forth.

The thermal activation thermal head 42 has a similar configuration to the thermal head used as a print head in publicly-known thermal printers; specifically, it is such that a protective layer of crystallized glass is provided on the surface of a plurality of heat-generating elements (heating resistors) formed on a ceramics substrate using a thin film technology or thick film technology. By using a printing thermal head as the thermal activation thermal head 42 in this way, cost reduction can be attained. Nevertheless, the heat-generating elements 41 of the thermal activation thermal head 42 need not be divided by dots as in the heat-generating elements of the printing thermal head, and they may be continuous resistors.

In such a thermal activation unit 40, when the stepping motor 24 is driven in response to a drive signal output from the motor-driving circuit 23 that has received an instruction from the CPU 70 shown in FIG. 2, the thermal activation platen roller 43 shown in FIG. 1 rotates anticlockwise. Thereby, the heat-sensitive adhesive sheet A that has been transferred by the pull-in rollers 20 is pulled into a gap over the thermal activation thermal head 42, and the pulled-in sheet A is fed out to the ejection rollers 50 side while being brought into pressure-contact with the heat-generating elements 41. At the same time, the heat-generating elements 41 starts a thermal activation operation (heat generation) according to the drive signal output from the thermal activation unit-driving circuit 45 that has received an instruction from the CPU 70, and the heat-sensitive adhesive agent layer of the heat-sensitive adhesive sheet A is heated and thermally activated.

It is desirable that the thermal activation unit 40 has a pressurizing-means, such as a coiled spring or a flat spring, for pressing the thermal activation thermal head 42 toward the thermal activation platen roller 43, and an adjusting means for adjusting the pressure force caused by the pressurizing means. In addition, it is desirable that the rotational axis of the thermal activation platen roller 43 and the alignment direction of the heat-generating elements 41 are kept parallel so that the entire heat-sensitive adhesive agent layer along its width direction is uniformly brought into pressure-contact with the thermal activation thermal head 42 (heat-generating elements 41).

The ejection rollers 50 shown in FIG. 1 comprise an upper ejection roller 51 (active roller) disposed upward of the transfer path R of the heat-sensitive adhesive sheet A and a lower ejection roller 52 (passive roller) disposed downward thereof. The stepping motor 24 shown in FIG. 2, which is also a driving source of the pull-in rollers 20, is coupled to the upper ejection roller 51 via a transmission mechanism, which is not shown in the drawings. On the other hand, the lower ejection roller 52 is rotatably attached on a rotational shaft. Then, when the stepping motor 24 is driven in response to a drive signal output from the motor-driving circuit 23 that has received an instruction from the CPU 70 shown in FIG. 2, the upper ejection roller 51 shown in FIG. 1 rotates anticlockwise. Thus, the heat-sensitive adhesive sheet A in which the heat-sensitive adhesive agent layer has been thermally activated by the thermal activation-unit 40 is pulled between the upper and lower ejection rollers 51 and 52, and is fed out from the ejection slot 2 to outside. At this time, the lower ejection roller 52 is driven-rotated according to the shift of the heat-sensitive adhesive sheet A while bringing the heat-sensitive adhesive sheet A into pressure-contact with the upper ejection roller 51. Nevertheless, the lower ejection roller 52 may be made as an active roller by coupling it to the stepping motor 24, and the upper ejection roller 51 may be made as a passive roller.

The ejection-detecting sensor 60 shown in FIG. 1 is an optical sensor and is installed in front of the ejection slot 2 with respect to the transfer direction of the heat-sensitive adhesive sheet A. The ejection-detecting sensor 60 optically detects the heat-sensitive adhesive sheet-A that is fed out from the ejection slot 2 by the ejection rollers 50 and outputs a sensor signal (ejection-detecting signal) to the sensor input circuit 74 shown in FIG. 2. The sensor input circuit 74 outputs the input ejection-detecting signal to the CPU 70. Nevertheless, the ejection-detecting sensor 60 may be a mechanical sensor or other sensors.

Figure 3:
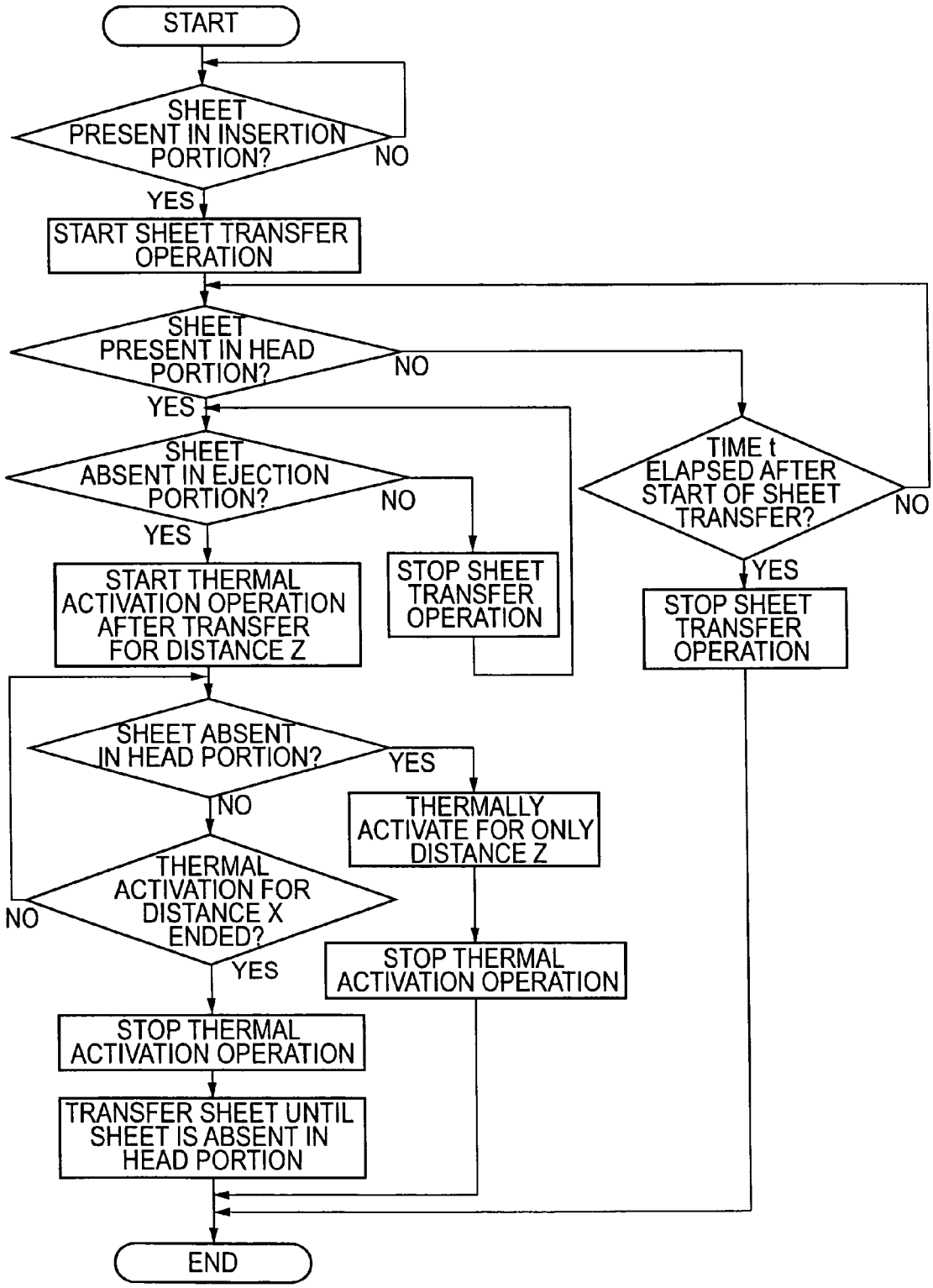
FIG. 3 is a chart diagram showing an operation flow of the heat-sensitive adhesive sheet thermal activation apparatus shown in FIG. 1.

Next, an operation example of the thermal activation apparatus P1 having the above-described configuration is described with reference to FIG. 3 in addition to FIGS. 1 and 2. FIG. 3 is a chart diagram showing the outline of an operation flow of the thermal activation apparatus P1.

(1) When the fore-end of the heat-sensitive adhesive sheet A inserted from the insertion slot 1 reaches the installation position of the insertion-detecting sensor 10 (denoted as "insertion portion" in FIG. 3), the fore-end is detected by the insertion-detecting sensor 10. The insertion-detecting sensor 10 that has detected the fore-end of the heat-sensitive adhesive sheet A outputs an insertion-detecting signal to the sensor input circuit 74, and the sensor input circuit 74 to which the insertion-detecting signal has been input outputs the input insertion-detecting signal to the CPU 70. On the other hand, in the cases where the heat-sensitive adhesive sheet A is not inserted into the insertion slot 1 or where, even if inserted, the fore-end of the heat-sensitive adhesive sheet A has not reached the installation position of the insertion-detecting sensor 10, the insertion-detecting signal is not output from the insertion-detecting sensor 10, and the thermal activation apparatus P1 does not operate.

(2) The. CPU 70 into which the insertion-detecting signal has been input outputs to the motor-driving circuit 23 an instruction for starting an operation ("to output an instruction" means "to output a control signal", likewise hereinafter). The motor-driving circuit 23 that has received the instruction for starting an operation from the CPU 70 outputs a drive signal to the stepping motor 24 so as to operate the motor 24. Then, the upper pull-in roller 21 starts to rotate anticlockwise (starts a transfer operation), and the heat-sensitive adhesive sheet A, the fore-end of which is inserted into the insertion slot 1, is pulled into the housing 3 and is transferred toward the thermal activation unit 40.

(3) When the fore-end of the heat-sensitive adhesive sheet A being transferred toward the thermal activation unit 40 reaches the installation position of the passage-detecting sensor 30 (denoted as "head portion" in FIG. 3), the fore-end is detected by the passage-detecting sensor 30. The passage-detecting sensor that has detected the fore-end of the heat-sensitive adhesive sheet A outputs a passage-detecting signal to the sensor input circuit 74, and the sensor input circuit 74 to which the passage-detecting signal is input outputs the input passage-detecting signal to the CPU 70. On the other hand, in the case where the passage-detecting signal is not input even when a predetermined time t has elapsed after the insertion-detecting signal is input, the CPU 70 outputs an instruction for stopping the operation to the motor-driving circuit 23. The motor-driving circuit 23 that has received the instruction for stopping the operation from the CPU 70 halts the output of the drive signal to the stepping motor 24, stopping the motor 24.

(4) If a passage-detecting signal is input within the predetermined time t, the CPU 70 confirms, based on the absence of the input of the ejection-detecting signal, that the heat-sensitive adhesive sheet A that was thermally activated at the previous time does not remain at the installation position of the ejection-detecting sensor 60 (denoted as "ejection portion" in FIG. 3). On the other hand, if there is an input of the ejection-detecting signal, the CPU 70 outputs to the motor-driving circuit 23 an instruction for stopping the transfer operation.

(5) If there is an input of the passage-detecting signal but there is no input of the ejection-detecting signal, the CPU 70 outputs an instruction for starting an operation to the thermal activation unit-driving circuit 45 after a predetermined time t1 has elapsed. Here, the predetermined time t1 is a time that is required for the fore-end of the heat-sensitive adhesive sheet A that has been detected by the passage-detecting sensor 30 to be transferred only for a distance Z between the passage-detecting sensor 30 and the thermal activation thermal head 40. The thermal activation unit-driving circuit 45 that has received an instruction for starting an operation from the CPU 70 outputs a drive signal to the thermal activation thermal head 42 (heat-generating elements 41), causing the heat-generating elements 41 of the thermal activation thermal head 42 to start heat generation (to start a thermal activation operation). Here, the thermal activation platen roller 43, which has a common driving source with the pull-in rollers 20, has already started to rotate anticlockwise simultaneously with the start of rotation of the pull-in rollers 20. As a result, the heat-sensitive adhesive sheet A that has been transferred by the pull-in rollers 20 is relayed to the thermal activation platen roller 43, and the relayed heat-sensitive adhesive sheet A is transferred to the ejection rollers 50 side while the heat-sensitive adhesive agent layer is being heated by the thermal activation thermal head 42 (heat-generating elements 41).

(6) Thereafter, when the input of the passage-detecting signal stops (when the rear end of the heat-sensitive adhesive sheet A passes the head portion), the CPU 70 outputs a control signal to the thermal activation unit-driving circuit 45 after the predetermined time t1 has elapsed, to stop the heat generation of the heat-generating elements 41. That is, the heat generation of the heat-generating elements 41 is stopped after the thermal activation operation has been continued for the above-mentioned distance Z. On the other hand, in the case where a thermal activation distance X is determined in advance, the CPU 70 makes the heat-generating elements 41 to generate heat only for a time t2 that is required for the heat-sensitive adhesive sheet A to be transferred only for the above-mentioned distance X. The heat-sensitive adhesive sheet A that has passed through the thermal activation unit 40 in the above-described manner is relayed to the ejection rollers 50 which has a common driving source with the pull-in rollers 20 and has started to rotate anticlockwise simultaneously with the start of rotation of the pull-in rollers 20 (which has started the ejection operation), and is fed out from the ejection slot 2 to outside.

(7) When a predetermined time t3 has elapsed after the input of the passage-detecting sensor stopped, the CPU 70 outputs an instruction for stopping the operation to the motor-driving circuit 23. The motor-driving circuit 23 that has received the operation stop instruction from the CPU 70 halts the output of the drive signal to the stepping motor 24, stopping the motor 24. Thereby, the pull-in rollers 20, the thermal activation platen roller 43, and the ejection rollers 50 are stopped. Here, the predetermined time t3 is a time that is required for the rear end of the heat-sensitive adhesive sheet A that has passed through the head portion to pass through the thermal activation thermal head 42. Accordingly, the predetermined time t3 becomes the same as the above-mentioned predetermined time t1 at the shortest.

(8) Thereafter, when the heat-sensitive adhesive sheet A that has been thermally activated and fed out from the ejection slot 2 is removed from the ejection slot 2, the input of the ejection-detecting signal to the CPU 70 stops.

[Embodiment 2]

Figure 4:
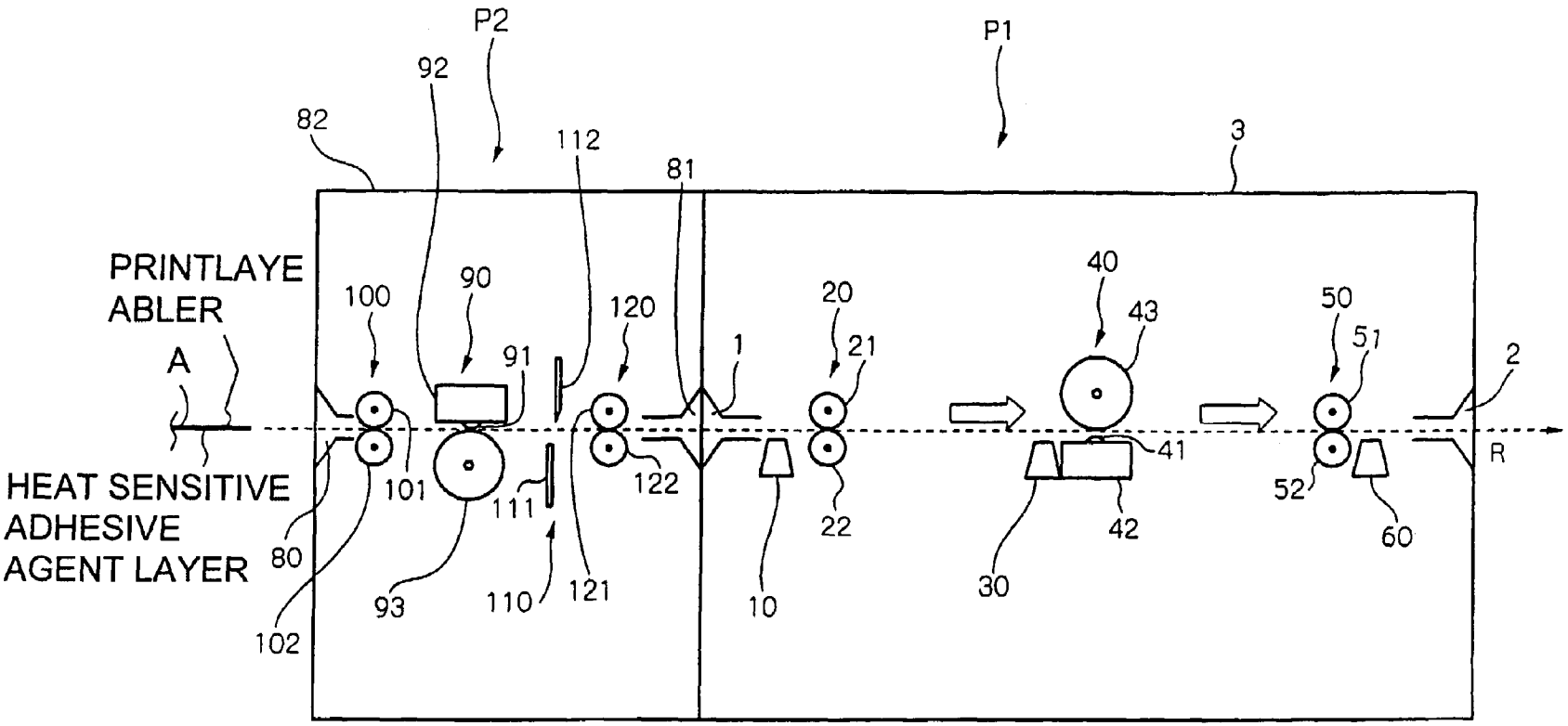
FIG. 4 is a configuration view showing the outline of a heat-sensitive adhesive sheet printer and a heat-sensitive adhesive sheet thermal activation apparatus of Embodiment 2.
Figure 5:
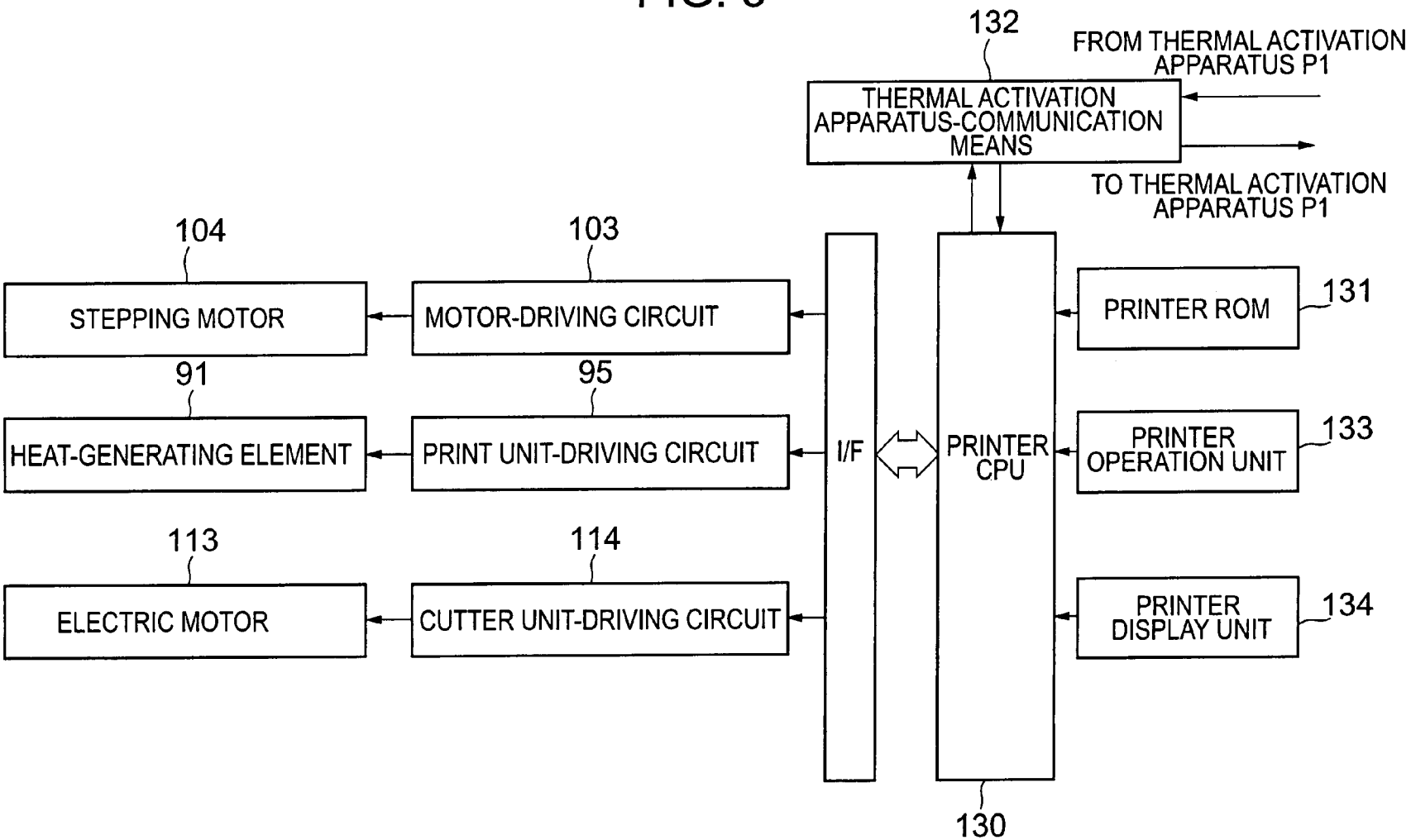
FIG. 5 is a block diagram of a control system and a drive system of the heat-sensitive adhesive sheet printer shown in FIG. 4.
Figure 6:
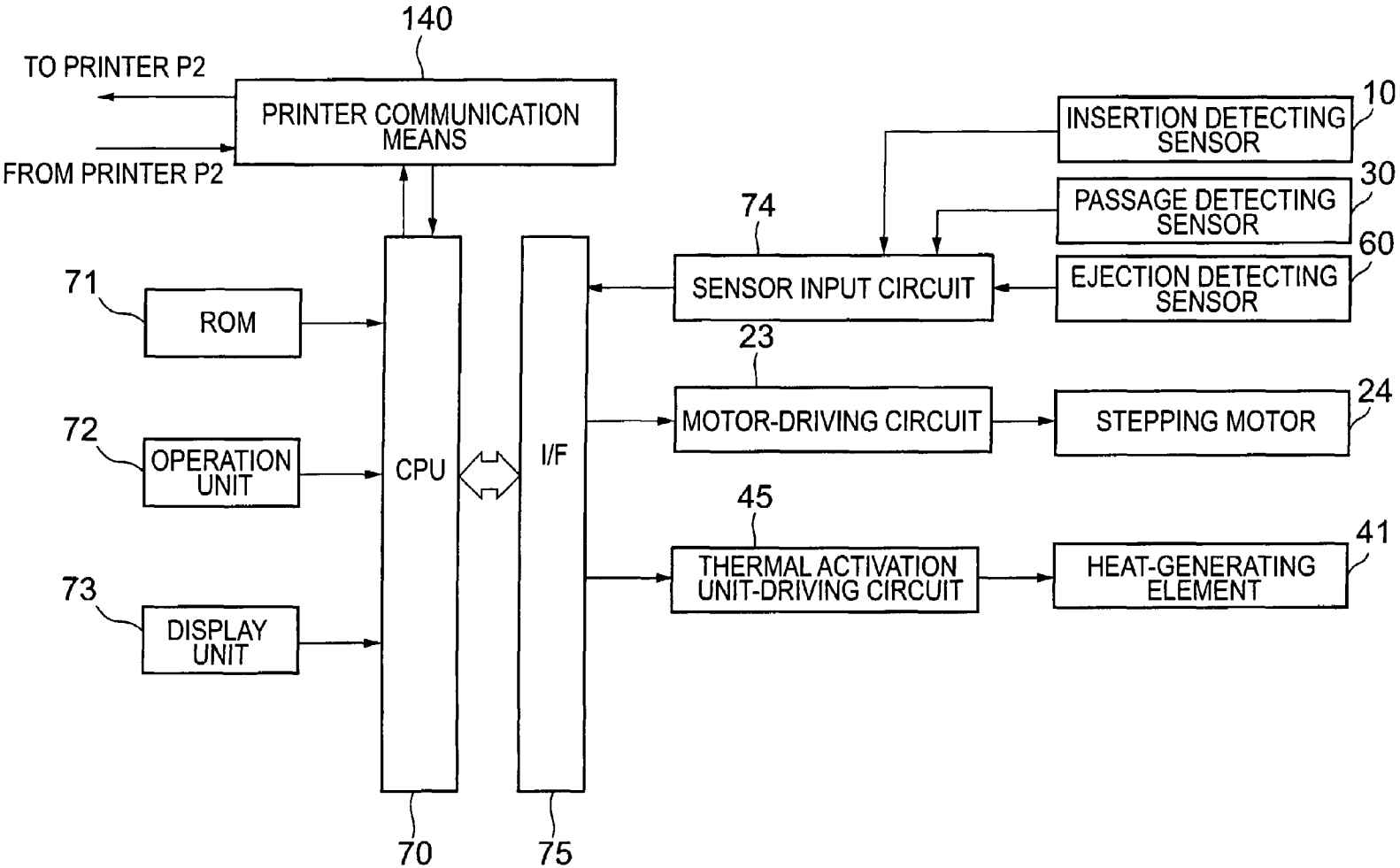
FIG. 6 is a block diagram of a control system and a drive system of the heat-sensitive adhesive sheet thermal activation apparatus shown in FIG. 4.
Figure 7:
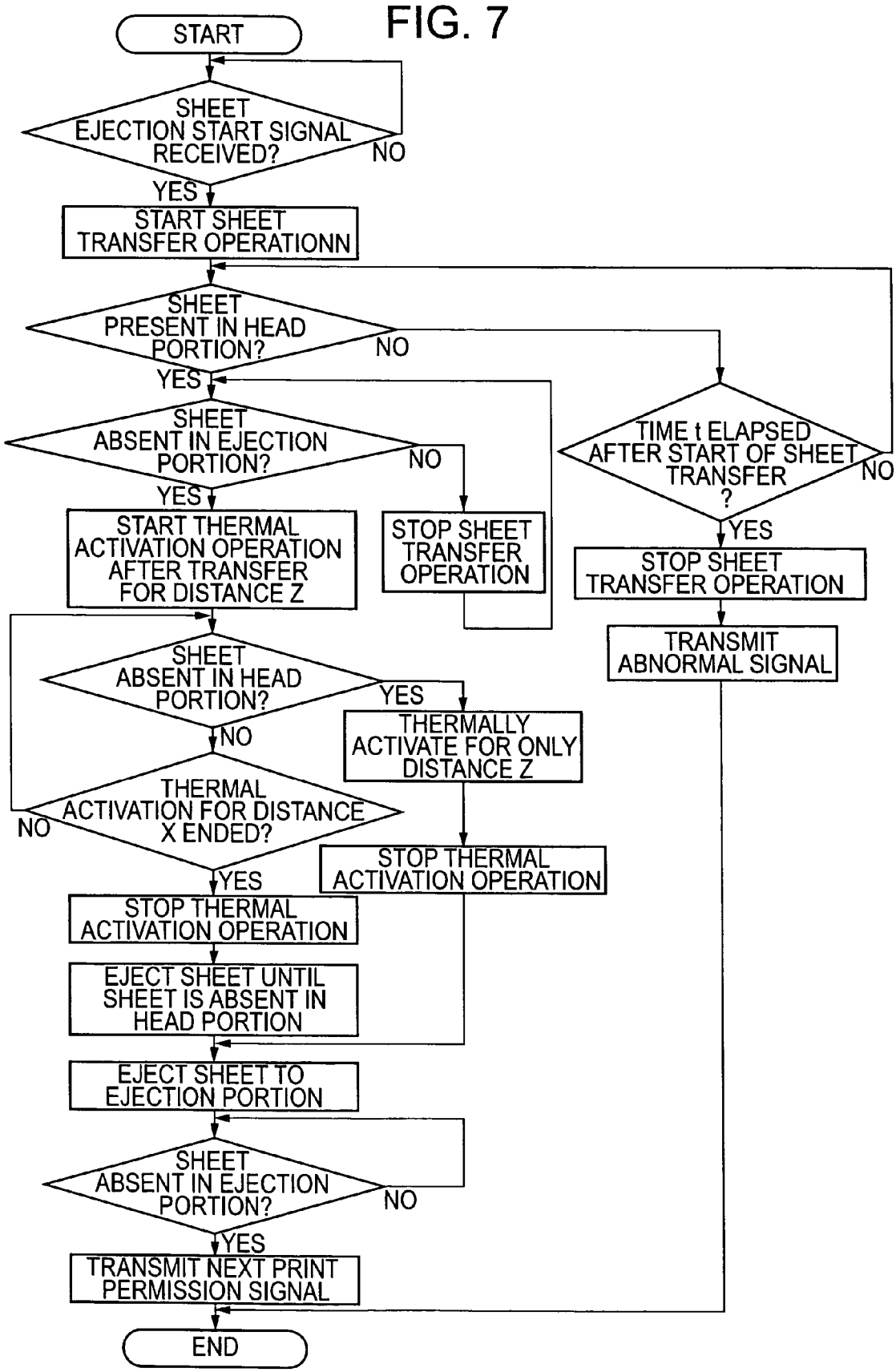
FIG. 7 is a chart diagram showing an operation flow of the heat-sensitive adhesive sheet thermal activation apparatus shown in FIG. 4.
Figure 8:
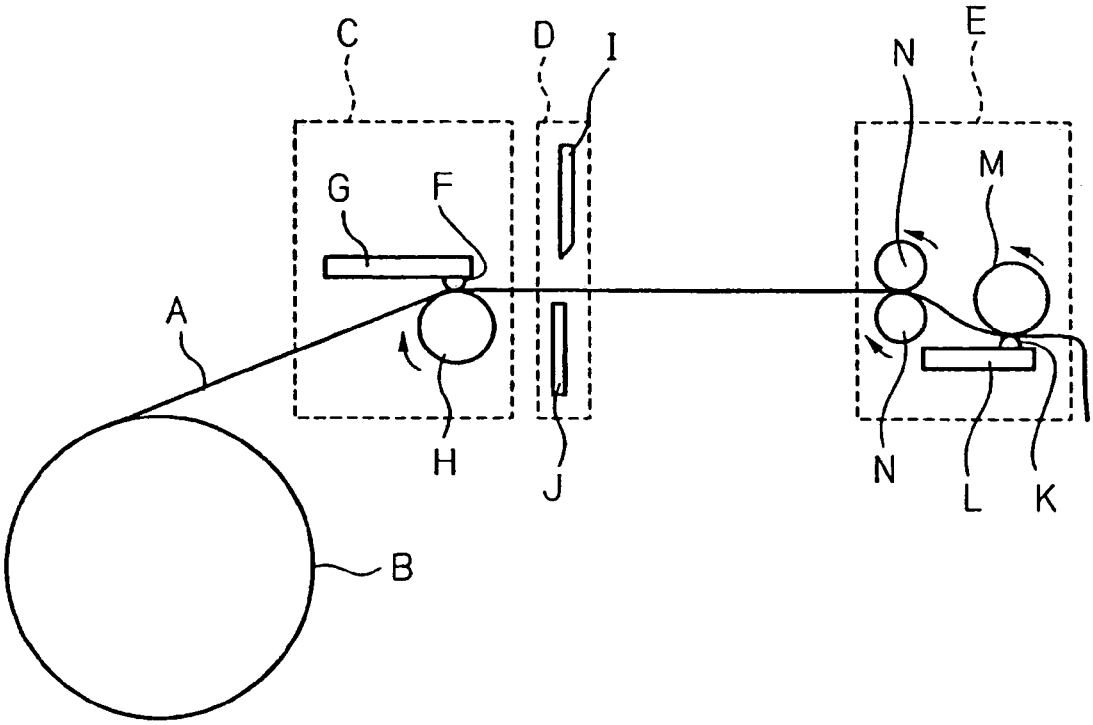
FIG. 8 PRIOR ART
FIG. 8 is a configuration view showing the outline of a conventional heat-sensitive adhesive sheet printer.

Hereinbelow, one embodiment of a heat-sensitive adhesive sheet printer and a heat-sensitive adhesive sheet thermal activation apparatus of the invention are explained in detail with reference to the drawings. FIG. 4 is a schematic view showing the configuration of a heat-sensitive adhesive sheet printer of the invention.(hereinafter referred to as a "printer P2") and a heat-sensitive adhesive sheet thermal activation apparatus of the invention (hereinafter referred to as a "thermal activation apparatus P1") that is attached to the printer P2. FIG. 5 is a block diagram for showing the outline of a control system and a drive system of the printer P2 shown in FIG. 4, and FIG. 6 is a block diagram showing the outline of a control system and a drive system of the thermal activation apparatus P1 shown in FIG. 4.

The printer P2 shown in FIG. 4 has a printer housing 82 in which a printer insertion slot 80, into which a heat-sensitive adhesive sheet A is inserted, and a printer ejection slot 81, from which the heat-sensitive adhesive sheet A is ejected, are formed and that is provided with an attaching/detaching means, not shown in the drawings, for permitting the thermal activation apparatus P1 to be attachable/detachable. The interior of the printer housing 82 is provided with: a print unit 90 for printing on a printable layer of the heat-sensitive adhesive sheet A; a pair of feed-in rollers 100 for transferring the heat-sensitive adhesive sheet A inserted from the printer insertion slot 80 to the print unit 90; a cutter unit 110 for cutting the already-printed heat-sensitive adhesive sheet A that has passed through the print unit 90 at a predetermined length; and a pair of feed-out rollers 120 for feeding out the already-printed heat-sensitive adhesive sheet A that has been cut by the cutter unit 110 from the printer ejection slot 81 to outside. Also, although omitted in FIG. 4, a control system and a drive system shown in FIG. 5 are also provided in the interior of the printer housing 82. The control system shown in FIG. 5 comprises: a printer CPU 130 serving as a control means for centrally managing the print unit 90, the feed-in rollers 100, the cutter unit 110, the feed-out rollers 120, and so forth; a printer ROM 131 that stores a control program or the like executed by the printer CPU 130; a thermal activation apparatus communication means 132 for performing communication with the thermal activation apparatus P1 attached through the attaching/detaching means; a printer operation unit 133 for inputting various necessary data and for calling the input data; a printer display unit 134 for displaying input/output data or other data; and so forth. The drive system shown in FIG. 5 will be described later.

The invention is not limited to any particular lamination to the heat-sensitive adhesive sheet A that can be printed by the printer P2 shown in FIG. 4. For example, a heat-sensitive adhesive label such as one described in the previously-mentioned Patent Document 1 is also included, in which a heat insulating layer and a heat-sensitive coloring layer (printable layer) are formed on an obverse surface of a sheet substrate material, and a heat-sensitive adhesive agent layer formed by coating and drying a heat-sensitive adhesive agent on the reverse surface. It should be noted that a general heat-sensitive adhesive agent has a thermoplastic resin, a solid plastic resin, and the like as its main component, and there are no particular limitations to the composition of the heat-sensitive adhesive agent either. In addition, the heat-sensitive adhesive sheet A includes a heat-sensitive adhesive label or the like in which a protective layer or a colored print layer (a layer that has been printed in advance) is formed on the surface of the heat-sensitive coloring layer.

The feed-in rollers 100 shown in FIG. 4 comprise an upper feed-in roller 101 (active roller) disposed upward of a transfer path R of the heat-sensitive adhesive sheet A and a lower feed-in roller 102 (passive roller) disposed downward thereof. A stepping motor 104, which is controlled by the printer CPU 130 through a motor-driving circuit 103 shown in FIG. 5, is coupled to the upper feed-in roller 101 via a transmission mechanism, which is not shown in the drawings. On the other hand, the lower feed-in roller 102 is rotatably attached on a rotational shaft. Then, when the stepping motor 104 is driven in response to a drive signal output from the motor-driving circuit 103 that has received an instruction from the printer CUP 130 shown in FIG. 5, the upper feed-in roller 101 starts to rotate anticlockwise. Thereby, the heat-sensitive adhesive sheet A that is inserted into the printer insertion slot 80 and is not yet printed is pulled between the upper and lower feed-in rollers 101 and 102 and is transferred toward the print unit 90. At this time, the lower feed-in roller 102 is driven-rotated according to the shift of the heat-sensitive adhesive sheet A while bringing the heat-sensitive adhesive sheet A into pressure-contact with the upper transfer roller 102. Nevertheless, the lower feed-in roller 102 may be made an active roller by coupling it to the stepping motor 104, and the upper. feed-in roller 101 may be a passive roller.

The print unit 90 shown in FIG. 4 comprises: a printing thermal head 92 that has a plurality of heat-generating elements 91 including a plurality of relatively small resistors arranged in the width direction so that dot printing is possible; a printing platen roller 93 that is brought into pressure-contact with the thermal head 92; the stepping motor 104 shown in FIG. 5, which is also a driving source of the printing platen roller 93; a print unit-driving circuit 95 for driving the printing thermal head 92 (heat-generating element 91); a transmission mechanism, not shown in the drawings, for transmitting a rotational driving force of the stepping motor 104 to the printing platen roller 93; and so forth.

The printing thermal head 92 shown in FIG. 4 has a similar configuration to the thermal head used as a print head in publicly-known thermal printers; specifically, it is such that a protective layer of crystallized glass is provided on a surface of a plurality of heat-generating elements (heating resistors) formed on a ceramics substrate using a thin film technology or thick film technology, and therefore, the detailed explanation will be omitted.

In such a print unit 90, when the stepping motor 104 is driven in response to a drive signal output from the motor-driving circuit 103 that has received an instruction from the printer CPU 130 shown in FIG. 5, its rotational driving force is transmitted to the printing platen roller 93 via the transmission mechanism, and the printing platen roller 93 starts to rotate clockwise. Thereby, the not-yet-printed heat-sensitive adhesive sheet A that has been transferred by the feed-in rollers 100 is pulled in a gap over the printing thermal head 92, and the printable layer is fed out to the cutter unit 110 while being brought into pressure-contact with the heat-generating element 91. At the same time, the printing thermal head 92 (heat-generating elements 91) starts a printing operation (heat generation) according to the drive signal output from the print unit-driving circuit 95 that has received an instruction from the printer CPU 130, and printing is performed on the printable layer.

It is desirable that the print unit 90 has a pressurizing means, such as a coiled spring and a flat spring, for pressing the printing thermal head 92 toward the printing platen roller 93, and an adjusting means for adjusting the pressure force caused by the pressurizing means. In addition, it is desirable that the rotational axis of the printing platen roller 93 and the alignment direction of the heat-generating elements 91 are kept parallel so that the entire printable layer along its width direction is uniformly brought into pressure-contact with the printing thermal head 92 (heat-generating elements 91). Nevertheless, other print heads than the thermal head may be employed insofar as the print heads can print the printable layer of the heat-sensitive adhesive sheet A.

The cutter unit 110 shown in FIG. 4 comprises: a stationary blade 111 disposed downward of the transfer path R of the heat-sensitive adhesive sheet A; a movable blade 112 disposed upward thereof and being capable of reciprocating motion such as to make contact with and come apart from the stationary blade 111; an electric motor 113 shown in FIG. 5 that is a driving source of the movable blade 112; a cutter unit-driving circuit 114; and so forth. In such a cutter unit 110, when the electric motor 113 is driven by the cutter unit-driving circuit 114 that has received an instruction from the printer CPU 130 shown in FIG. 5, the movable blade 112 descends so as to approach the stationary blade 111, cuts the heat-sensitive adhesive sheet A on the transfer path R, and thereafter ascends to return the original position.

The feed-out rollers 120 shown in FIG. 4 comprise an upper feed-out roller 121 (active roller) disposed upward of the transfer path R of the heat-sensitive adhesive sheet A and a lower feed-out roller 122 (passive roller) disposed downward thereof. The stepping motor 104 shown in FIG. 5, which also serves as a driving source of the feed-in rollers 100, is coupled to the upper feed-out roller 121 via a transmission mechanism, which is not shown in the drawings. On the other hand, the lower feed-out roller 122 is rotatably attached on a rotational shaft. Then, when the stepping motor 104 is driven in response to the drive signal output from the motor-driving circuit 103 that has received an instruction from the printer CPU 130 shown in FIG. 5, the upper feed-out roller 121 starts to rotate anticlockwise. Thereby, the already-printed heat-sensitive adhesive sheet A that has been cut by the cutter unit 110 is pulled between the upper and lower feed-out rollers 121 and 122 and is fed out from the printer ejection slot 81 to outside. At this time, the lower feed-out roller 122 is driven-rotated according to the shift of the heat-sensitive adhesive sheet A while bringing the heat-sensitive adhesive sheet A into pressure-contact with the upper feed-out roller 121. Nevertheless, the lower feed-out roller 122 may be made an active roller by coupling it to the stepping motor 104, and the upper feed-out roller 121 may be a passive roller.

The thermal activation apparatus P1 shown in FIG. 4 has basically the same configuration as that of the thermal activation apparatus P1 shown in FIG. 1. For this reason, among the configurations of the thermal activation apparatus P1 shown in FIG. 4, the same configurations as the configurations of the thermal activation apparatus P1 shown in FIG. 1 are denoted by the same reference characters, and the explanations thereof are omitted.

In addition, the thermal activation apparatus P1 shown in FIG. 4 has basically the same control system and drive system as those of the thermal activation apparatus P1 shown in FIG. 1. One of the differences is to have a printer communication means 140 for performing communication with the printer P2. Another one of the differences is to have a control program such that the CPU 70 transmits and receives signals and data that are mutually recognizable with the printer CPU 130 of the printer P2 through the printer communication means 140, and performs control based on the received signals and data.

Next, an operation example of the printer P2 and the thermal activation apparatus P1 having the above-described configuration is explained with reference to FIGS. 4 to 7. Nevertheless, since the operation of the printer P2 shown in FIG. 4 is basically the same as the conventional printer, only the characteristic portions will be explained and the rest are omitted. Also, since the operation of the thermal activation apparatus P1 shown in FIG. 4 is basically the same as the operation of the thermal activation apparatus P1 shown in FIG. 1, only the differences are explained and the rest are omitted.

The printer CPU 130 of the printer P2 shown in FIG. 4 outputs an instruction for starting an operation to the motor-driving circuit 103 so as to operate the feed-in rollers 100, the printing platen roller 93, and the feed-out rollers 120, and also transmits a signal for announcing the start of ejection of the sheet A to the thermal activation apparatus P1 via the thermal activation apparatus communication means 132. On the other hand, the CPU 70 of the thermal activation apparatus P1 receives the signal for announcing the ejection, which is transmitted from the printer P2, via the printer communication means 140, and outputs an instruction for starting an operation to the motor-driving circuit 23. Here, in order not to apply tension to the heat-sensitive adhesive sheet A stretching between the printer P2 and the thermal activation apparatus P1, timing is determined in advance between the transmission of the above-mentioned signal by the printer P2 or the reception of the above-mentioned signal by the thermal activation apparatus P1 and the start of transfer operation of the thermal activation apparatus P2. Nevertheless, because the thermal activation apparatus P1 is provided with the insertion-detecting sensor 10, it is possible to output the instruction for starting the operation to the motor-driving circuit 23 at the time when both the above-described signal and the insertion-detecting signal are input.

The CPU 70 of the thermal activation apparatus P1 shown in FIG. 1 only outputs the instruction for stopping the operation to the motor-driving circuit 23 to stop the stepping motor 24 in the case where there is no input of the passage-detecting signal when the predetermined time t has elapsed after the insertion-detecting signal was input. However, the CPU 70 of the thermal activation apparatus P1 of FIG. 4, which has the printer communication means 140 for performing communication with the printer P2, outputs the instruction for stopping the operation to the motor-driving circuit 23 and also transmits an abnormal signal to the printer P2 via the printer communication means 140. On the other hand, the printer CPU 130 of the printer P2 receives the abnormal signal transmitted from the thermal activation apparatus P1 via the thermal activation apparatus communication means 132, and outputs the stop instruction to each of the drive circuits, stopping the stepping motor and the heat-generating elements in operation.

In addition, the CPU 70 of the thermal activation apparatus P1 of FIG. 4, which has the printer communication means 140 for performing communication with the printer P2, transmits a next printing permission signal to the printer P2 via the printer communication means 140 after the input of the ejection-detecting signal has stopped on the other hand, the printer CPU 130 of the printer P2 receives the print permission signal that has been transmitted from the thermal activation apparatus P1 via the thermal activation apparatus communication means 132 and outputs an instruction to each of the drive circuits to start a printing operation.

The printer P2 and the thermal activation apparatus P1 shown in FIG. 4, which are capable of transmitting and receiving mutually recognizable signals and data each other, can perform the following coordinated operation in addition to the above-described coordinated operation. For example, if some kind of abnormality occurs in the printer P2, it is possible that an abnormal signal is transmitted from the printer P2 to the thermal activation apparatus P1, and the CPU 70 of the thermal activation apparatus P1 that receives the abnormal signal outputs an instruction for stopping the operation to a predetermined drive circuit. Moreover, it is possible that a signal for announcing the start of thermal activation operation is transmitted from the printer P2 to the thermal activation apparatus P1, and the CPU 70 of the thermal activation apparatus P1 that received the signal outputs an instruction to a predetermined drive circuit to start the thermal activation operation.

Furthermore, it is also possible to transmit a signal for designating a thermal activation area from the printer P2 to the thermal activation apparatus P1 so that the CPU 70 of the thermal activation apparatus P1 that receives the signal controls the thermal activation unit 40 so that only the designated area portion can be thermally activated in the heat-sensitive adhesive agent layer of the heat-sensitive adhesive sheet A. In this case, it is possible that, by operating the printer operation unit 133 provided for the printer P2 to input a desired thermal activation area, the input thermal activation area can be transmitted to the thermal activation apparatus P1. In addition, in the case where one of the width or length of the thermal activation is fixed, it is possible to input one of the values that is not fixed by operating the printer operation unit 133 provided for the printer P2 so that the printer CPU 130 calculates the thermal activation area and the calculated thermal activation area is transmitted to the thermal activation apparatus P1. Nevertheless, it is possible that the printer P2 transmits the numerical value input from the operation unit 133 as it is to the thermal activation apparatus P1 and the calculation of the thermal activation area is performed in the thermal activation apparatus P1. It should be noted that, regardless of how the thermal activation area is designated, the CPU 70 of the thermal activation apparatus P1 allows only the designated thermal activation area in the heat-sensitive adhesive agent layer to be activated by varying the number of the heat-generating elements to be driven, the drive duration, and the like according to the thermal activation area.

[Other Embodiments]

Embodiment 2 explained a case in which the thermal activation apparatus P1 is attached to/detached from the printer P2 with the attaching/detaching means provided in the printer P2. However, the attaching/detaching means may be provided in the thermal activation apparatus P1, or may be provided in both. Moreover, when communication is performed between the printer P2 and the thermal activation apparatus P1 that can be integrated by the attaching/detaching means as exemplified in Embodiment 2, it is convenient if both the printer P1 and the thermal activation apparatus P1 are provided with connectors for communication that are automatically connected with each other when they are integrated. Nevertheless, in order to realize communication between the printer P2 and the thermal activation apparatus P1, it is not particularly necessary that both are integrated by the attaching/detaching means or the like, and it may be only necessary to connect between the communication connectors with a cable or the like.

The cutter unit 110 provided for the printer P2, which was explained in Embodiment 2, may be provided for the thermal activation apparatus that was explained in Embodiment 1 or Embodiment 2.

The drive systems for the pull-in rollers 20, the thermal activation unit 40, and the ejection rollers 50 provided for the thermal activation apparatus P1 explained in Embodiment 1 have the stepping motor serving as the driving source in common, but it is possible to provide independent stepping motors respectively. Moreover, the driving source may be DC motors or the like other then the stepping motor. Further, it is possible to provide two or more independent stepping motors for the drive systems of the printer P2 and the thermal activation apparatus P1 explained in Embodiment 2, and it is also possible to provide a driving source other than the stepping motor. Furthermore, in the case where the printing platen roller 93 of the printer P2 also serves the function of the pull-in rollers 100, it is also possible to omit the pull-in rollers 100.

In addition, the following control mode is also conceivable in a configuration in which communication is possible between the printer and the thermal activation apparatus. For example, the control mode is such that control information including start timing of the thermal activation operation, thermal activation pattern, sheet length of the heat-sensitive adhesive sheet, print speed and sheet feeding speed (pitch) of the printer, and so forth is transmitted from the printer to the thermal activation apparatus, and the CPU of the thermal activation apparatus that receives the control information selects, based on the received control information, an optimum control program among a plurality of control programs to execute the program. Also, timing of cutting the heat-sensitive adhesive sheet may be included in the above-mentioned control information in the case where the thermal activation apparatus has a cutter unit. Further, another conceivable mode is such that one of the printer or the thermal activation apparatus can be completely controlled from the other.

The printer of the invention maybe provided with a feed-out means of a plate material or the like that can guide the already-printed heat-sensitive adhesive sheet ejected from the printer ejection slot to the insertion slot of the thermal activation apparatus. Further, the thermal activation apparatus of the invention may be provided with a pull-receiving means of a plate material or the like that can guide the already-printed heat-sensitive adhesive sheet ejected from the printer ejection slot of the printer to the insertion slot of the thermal activation apparatus.

A heat-sensitive adhesive sheet thermal activation apparatus of the invention comprises at least: an insertion slot for inserting a heat-sensitive adhesive sheet wherein a printable layer is formed on one surface of a sheet-like substrate material and a heat-sensitive adhesive agent layer is formed on the other surface thereof; transfer means for transferring the heat-sensitive adhesive sheet that has been inserted into the insertion slot; thermal activation means for thermally activating the heat-sensitive adhesive agent layer of the heat-sensitive adhesive sheet by heating; and ejection means for ejecting the heat-sensitive adhesive sheet in which the heat-sensitive adhesive agent layer has been thermally activated. Therefore, it becomes possible to thermally activate a heat-sensitive adhesive agent layer of a heat-sensitive adhesive sheet that has been printed by a separate printer as needed. In addition, it becomes possible to thermally activate the heat-sensitive adhesive agent layer of the heat-sensitive adhesive sheet previously and thereafter print with an arbitrary printing means or hand-write on the printable layer. Moreover, it also becomes possible to attach the heat-sensitive adhesive sheet to a subject material beforehand and thereafter print or hand-write on the printable layer.

By providing an insertion slot for inserting an already-printed heat-sensitive adhesive sheet ejected from a printer that can print on the printable layer of a heat-sensitive adhesive sheet in which a printable layer is formed on one surface of a sheet-like substrate material and a heat-sensitive adhesive agent layer is formed on the other surface, it becomes possible to accept the heat-sensitive adhesive sheet printed by a separate printer continuously or at any time and to thermally activate the heat-sensitive adhesive agent layer of that heat-sensitive adhesive sheet.

By providing a printer attaching/detaching means for attaching/detaching a printer that can print the printable layer of a heat-sensitive adhesive sheet in which a printable layer is formed on one surface of a sheet-like substrate material and a heat-sensitive adhesive agent layer is formed on the other surface, it becomes possible to couple the printer as needed and to thermally activate the heat-sensitive adhesive agent layer of the heat-sensitive adhesive sheet that has been printed by that printer.

By providing a cutting means for cutting a heat-sensitive adhesive sheet at a desired length, it becomes possible to cut the heat-sensitive adhesive sheet at a desired length before the heat-sensitive adhesive agent layer is thermally activated or after thermally activated. Therefore, thermal activation and cutting of a heat-sensitive adhesive sheet can be realized with a single apparatus. For example, such a mode of use is possible that a long sheet in which the same design is repeatedly printed or a continues design is printed is cut as necessary and only the cut portions are thermally activated.

By providing a printer communication means for performing communication with a printer that is capable of printing a printable layer of a heat-sensitive adhesive sheet, it is possible to control the printer, or, conversely, to receive control from the printer, or to perform control according to the operation status of the printer.

A heat-sensitive adhesive sheet printer of the invention comprises at least: printing means for printing the printable layer of a heat-sensitive adhesive sheet in which a printable layer is formed on a sheet-like substrate material and a heat-sensitive adhesive agent layer is formed on the other surface; transfer means for transferring the heat-sensitive adhesive sheet to the printing means; paper-ejecting means for ejecting the heat-sensitive adhesive sheet that has already been printed; and thermal activation apparatus-attaching/detaching means for attaching/detaching a heat-sensitive adhesive sheet thermal activation apparatus for thermally activating the heat-sensitive adhesive agent layer of the heat-sensitive adhesive sheet. Therefore, it is usable as a normal printer by itself, and if the thermal activation apparatus is coupled thereto, it is also usable as a conventional heat-sensitive adhesive sheet printer in which a thermal activation mechanism is integrally provided.

By providing a thermal activation apparatus communication means for performing communication with a heat-sensitive adhesive sheet thermal activation apparatus, it is possible to control the thermal activation apparatus, or conversely to receive control from the thermal activation apparatus, or to perform control according to the operation status of the thermal activation apparatus.

What is claimed is:

1. A thermal activation apparatus comprising:

a housing having an insertion slot for insertion therethrough of a heat-sensitive adhesive sheet into the housing, the heat-sensitive adhesive sheet having a printable surface formed on one side of a sheet-like base and a heat-sensitive adhesive layer formed on the other side thereof;

insertion-detecting means for detecting the heat-sensitive adhesive sheet inserted through the insertion slot and for outputting a detection signal for determining a start time of the thermal activation apparatus when the heat-sensitive adhesive sheet is detected;

transfer means for transferring along a transfer path in the housing the heat-sensitive adhesive sheet that has been inserted through the insertion slot;

thermal activation means for thermally activating the heat-sensitive adhesive layer of the heat-sensitive adhesive sheet transferred by the transfer means;

ejection means for ejecting from the housing the heat-sensitive adhesive sheet after the heat-sensitive adhesive layer has been thermally activated;

control means disposed within the housing for controlling operation of the thermal activation apparatus, the control means including printer communication means for communicating the thermal activation apparatus with a controller of a separate and independent printer that is configured to print on the printable surface of the heat-sensitive adhesive sheet; and ejection detecting means for sending a detection signal indicating that the heat sensitive adhesive sheet is being ejected, the printer communication means sending a signal to the printer controller for starting a printing operation in response to the ejection detection signal.

2. A thermal activation apparatus according to claim 1; wherein control means controls the transfer means so that the transfer means starts a transfer operation when the heat-sensitive adhesive sheet is detected by the insertion-detecting means.

3. A thermal activation apparatus according to claim 1; further comprising: passage-detecting means for detecting the heat-sensitive adhesive sheet transferred to the thermal activation means by the transfer means; and wherein the control means controls the thermal activation means so that the thermal activation means starts a thermal activation operation when the heat-sensitive adhesive sheet is detected by the passage-detecting means.

4. A thermal activation apparatus according to to claim 1; further comprising: passage-detecting means for detecting the heat-sensitive adhesive sheet transferred to the thermal activation means by the transfer means; and wherein the control means controls the thermal activation means so that the thermal activation means starts a thermal activation operation when the heat-sensitive adhesive sheet is detected by the passage-detecting means and so that the thermal activation means stops the thermal activation operation when the heat-sensitive adhesive sheet is not detected by the passage-detecting means.

5. A thermal activation apparatus according to claim 1; further comprising: passage-detecting means for detecting the heat-sensitive adhesive sheet transferred to the thermal activation means by the transfer means; and wherein the control means controls the thermal activation means and the ejection means so that the thermal activation means starts a thermal activation operation when the heat-sensitive adhesive sheet is detected by the passage-detecting means and so that the thermal activation means stops the thermal activation operation and the ejection means starts an ejection operation when the heat-sensitive adhesive sheet is not detected by the passage-detecting means.

6. A thermal activation apparatus according to claim 1; wherein the control means controls the thermal activation means so that only an area of the heat-sensitive adhesive layer of the heat-sensitive adhesive sheet that is externally designated is thermally activated.

7. A thermal activation apparatus comprising:

a housing having an insertion slot for insertion therethrough of a heat-sensitive adhesive sheet into the housing, the heat-sensitive adhesive sheet having a printable surface formed on one side of a sheet-like base and a heat-sensitive adhesive layer formed on the other side thereof;

insertion-detecting means for detecting the heat-sensitive adhesive sheet inserted through the insertion slot and for outputting a detection signal for determining a start time of the thermal activation apparatus when the heat-sensitive adhesive sheet is detected;

transfer means for transferring along a transfer path in the housing the heat-sensitive adhesive sheet that has been inserted through the insertion slot;

thermal activation means for thermally activating the heat-sensitive adhesive layer of the heat-sensitive adhesive sheet transferred by the transfer means;

ejection means for ejecting from the housing the heat-sensitive adhesive sheet after the heat-sensitive adhesive layer has been thermally activated;

printer communication means disposed in the housing of the thermal activation apparatus for communicating the thermal activation apparatus with a controller of a separate and independent printer that is configured for printing on the printable surface of the heat-sensitive adhesive sheet; and ejection detecting means for sending a detection signal indicating that the heat sensitive adhesive sheet is being ejected, the printer communication means sending a signal to the printer controller for starting a printing operation in response to the ejection detection signal.

8. A thermal activation apparatus according to claim 7; further comprising control means for controlling at least one of the transfer means, the thermal activation means, and the ejection means according to a control signal transmitted from the printer and received by the printer communication means.

9. A thermal activation apparatus according to claim 7; further comprising control means for stopping operation of at least one of the transfer means, the thermal activation means, and the ejection means when an abnormal signal transmitted from the printer is received by the printer communication means.

10. A thermal activation apparatus according to claim 7; further comprising control means for controlling the transfer means so that the transfer means starts a transfer operation when a paper-ejection start signal transmitted from the printer is received by the printer communication means.

11. A thermal activation apparatus according to claim 7; further comprising control means for controlling the thermal activation means so that the thermal activation means starts a thermal activation operation when a thermal activation operation-starting signal transmitted from the printer is received by the printer communication means.

12. A thermal activation apparatus according to claim 7; further comprising control means for controlling the thermal activation means so that only a designated area of the heat-sensitive adhesive layer of the heat-sensitive adhesive sheet is thermally activated when a thermal activation area-designating signal transmitted from the printer is received by the printer communication means.

13. A thermal activation apparatus according to claim 7; further comprising control means for transmitting a printing signal to the printer to start a printing operation.

14. A thermal activation apparatus according to claim 1; wherein the printer communication means communicates the thermal activation apparatus with a printer for printing on the printable surface of the heat-sensitive adhesive sheet before thermal activation of the heat-sensitive adhesive layer of the heat-sensitive adhesive sheet.

15. In combination:

a thermal activation apparatus comprising an insertion slot for insertion therethrough of a heat-sensitive adhesive sheet having a printable surface formed on one side of a sheet-like base and a heat-sensitive adhesive layer formed on the other side thereof, a transfer unit for transferring along a transfer path the heat-sensitive adhesive sheet that has been inserted through the insertion slot, a thermal activation unit for thermally activating the heat-sensitive adhesive layer of the heat-sensitive adhesive sheet transferred by the transfer unit, and an ejection unit for ejecting the heat-sensitive adhesive sheet after the heat-sensitive adhesive layer has been thermally activated;

a printer separate and independent from the thermal activation apparatus and removably connected to the thermal activation apparatus, the printer having control means integral with the printer for controlling operation of the printer;

printer communication means integral with the thermal activation apparatus for communicating the thermal activation apparatus with the printer the printer control means for printing on the printable surface of the heat-sensitive adhesive sheet; and ejection detecting means for sending a detection signal indicating that the heat sensitive adhesive sheet is being ejected, the printer sending a signal to the printer controller for starting a printing operation in response to the ejection detection signal.

16. A combination according to claim 15; further comprising a detector for detecting the heat-sensitive adhesive sheet inserted through the insertion slot and for outputting a detection signal for determining a start time of the thermal activation apparatus when the heat-sensitive adhesive sheet is detected.

17. A combination according to claim 15;

wherein the thermal activation apparatus further comprises a housing having the insertion slot and housing the transfer unit, the thermal activation unit and the ejection unit.

18. A combination according to claim 17; wherein the thermal activation apparatus further comprises control means for controlling operation of the thermal activation apparatus, the control means and the printer communication means being disposed in the housing of the thermal activation apparatus.

19. A combination according to claim 15; wherein the thermal activation apparatus further comprising control means for controlling at least one of the transfer unit, the thermal activation unit, and the ejection unit according to a control signal transmitted from the printer and received by the printer communication means.

20. A combination according to claim 15; wherein the thermal activation apparatus further comprising control means for stopping operation of at least one of the transfer unit, the thermal activation unit, and the ejection unit when an abnormal signal transmitted from the printer is received by the printer communication means.

21. A combination according to claim 15; wherein the thermal activation apparatus further comprising control means for controlling the transfer unit so that the transfer unit starts a transfer operation when a paper-ejection start signal transmitted from the printer is received by the printer communication means.

22. A combination according to claim 15; wherein the thermal activation apparatus further comprising control means for controlling the thermal activation unit so that the thermal activation unit starts a thermal activation operation when a thermal activation operation-starting signal transmitted from the printer is received by the printer communication means.

23. A combination according to claim 15; wherein the thermal activation apparatus further comprising control means for controlling the thermal activation unit so that only a designated area of the heat-sensitive adhesive layer of the heat-sensitive adhesive sheet is thermally activated when a thermal activation area-designating signal transmitted from the printer is received by the printer communication means.

24. A combination according to claim 15; wherein the thermal activation apparatus further comprising control means for controlling the printer communication means to transmit a printing signal to the printer to start a printing operation.

* * * * *